US006431126B2

(12) United States Patent
Saito

(10) Patent No.: US 6,431,126 B2
(45) Date of Patent: Aug. 13, 2002

(54) ENGINE GENERATOR

(75) Inventor: Shinichi Saito, Tokyo-To (JP)

(73) Assignee: Fuji Jukogyo Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 09/778,802

(22) Filed: Feb. 8, 2001

(30) Foreign Application Priority Data

Feb. 9, 2000 (JP) ..... 2000-031968

(51) Int. Cl.[7] ..... F02B 63/00; F01P 1/02
(52) U.S. Cl. ..... 123/2; 123/41.7; 290/1 B
(58) Field of Search ..... 123/2, 41.7; 290/1 B; 181/204; 180/68.1; 310/50

(56) References Cited

U.S. PATENT DOCUMENTS 4,608,946 A * 9/1986 Tanaka et al. ..... 123/2
4,859,886 A * 8/1989 Tanaka et al. ..... 310/51
4,907,546 A * 3/1990 Ishii et al. ..... 123/2
6,091,160 A * 7/2000 Kouchi et al. ..... 290/1 A
6,331,740 B1 * 12/2001 Morohoshi et al. ..... 290/1 A

FOREIGN PATENT DOCUMENTS

JP 197418 * 11/1983 ..... F01P/5/06
JP 74327 * 4/1984 ..... F01P/5/06
JP 311226 * 11/1998 ..... F02B/63/04
JP 221055 * 8/2001 ..... F02B/63/04

* cited by examiner

*Primary Examiner*—Tony M. Argenbright
*Assistant Examiner*—Hai Huynh
(74) *Attorney, Agent, or Firm*—Smith, Gambrell & Russell, LLP

(57) ABSTRACT

An engine generator has an engine and a muffler driven by the engine, both protected by an engine cover. The engine cover has a double-wall structure of an outer wall that protects the engine generator, an inner wall that forms a space for containing the engine and used as a cooling-air passage through which the engine and the muffler are cooled, and a hollow inner space formed between the outer and the inner walls.

5 Claims, 4 Drawing Sheets

ENGINE GENERATOR

BACKGROUND OF THE INVENTION

The present invention relates to an engine generator having an engine, a generator and a muffler protected by an engine cover.

For a so-called engine generator in which an engine and a generator that is driven by the engine are both arranged, the components, such as an engine, are mostly protected by a sound insulating cover. Such an engine generator requires openings as small as possible for sound insulation whereas those as large as possible for cooling the inside of an engine cover. To meet these contradictory requirements, most engine generators have an engine-driven cooling fan protected by an engine cover for circulating air taken thereinto for high cooling efficiency.

Japanese Unexamined-Patent Publication No. 11-36880 discloses an engine generator provided with a cooling fan for improving sound insulation and cooling efficiency. The engine generator has a generator, an engine, and a muffler aligned in this order and surrounded by ducts protected by a cover. A cooling air is introduced into the duct from the generator side.

In other words, the engine, the muffler, etc., are protected by both the ducts and the cover. Cooling is performed in the order from the generator that will generate heat of relatively low temperature to the engine and muffler that will generate heat of high temperature.

Sound insulation is improved by means of double structure of the ducts and cover. Moreover, the engine generator is cooled efficiently because of cooling in the above order.

However, due to such a double structure that covers an engine and a muffler, and moreover, covered with an engine cover, as disclosed, such an engine generator is disadvantageous in that the number of components and assembly steps increases, thus raising cost.

SUMMARY OF THE INVENTION

A purpose of the present invention is to provide an engine generator having a small number of components and exhibiting sound-insulation capability with high cooling efficiency.

The present invention provides an engine generator having an engine and a muffler driven by the engine, both protected by an engine cover, the engine cover having a double-wall structure of an outer wall that protects the engine generator, an inner wall that forms a space for containing the engine and used as a cooling-air passage through which the engine and the muffler are cooled, and a hollow inner space formed between the outer and the inner walls.

DETAILED DESCRIPTION OF PREFERRED EMBODIMENTS

Preferred embodiments according to the present invention will be disclosed with reference to the attached drawings.

An engine generator according to the present invention is a type of generator in which a generator is driven by an engine.

Figure 1:
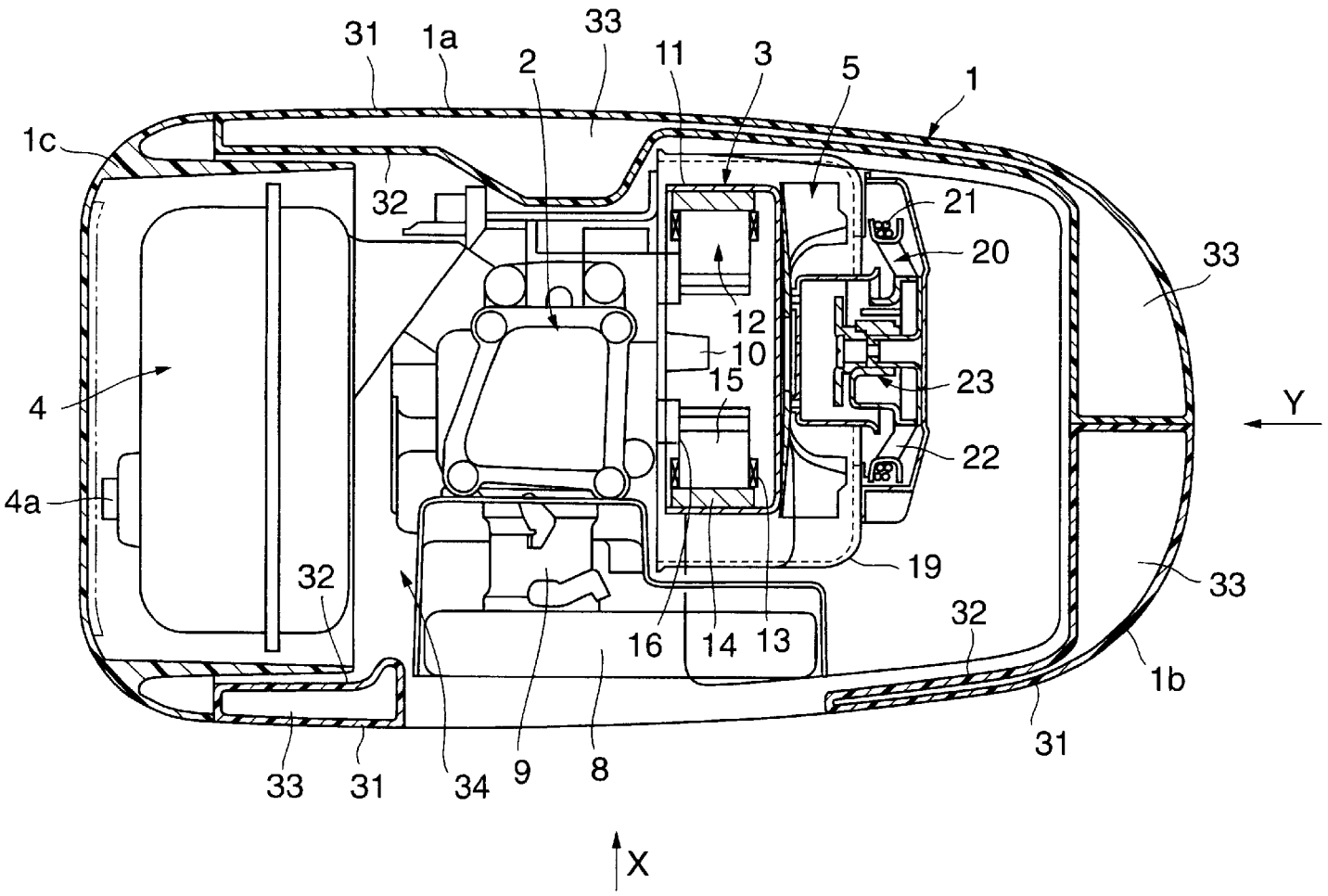
FIG. 1 is a plan view illustrating an internal structure of an engine generator according to a preferred embodiment of the present invention.

As illustrated in FIG. 1, protected by an engine cover 1 made of synthetic resin are an engine 2, a generator 3, a muffler 4, a cooling fan 5, and so on.

In the present invention, the engine cover 1 is constructed of covers 1*a* and 1*b* that form a hollow double-wall structure, thus achieving reduction of the number of components and improving high sound-insulation capability.

Figure 4:
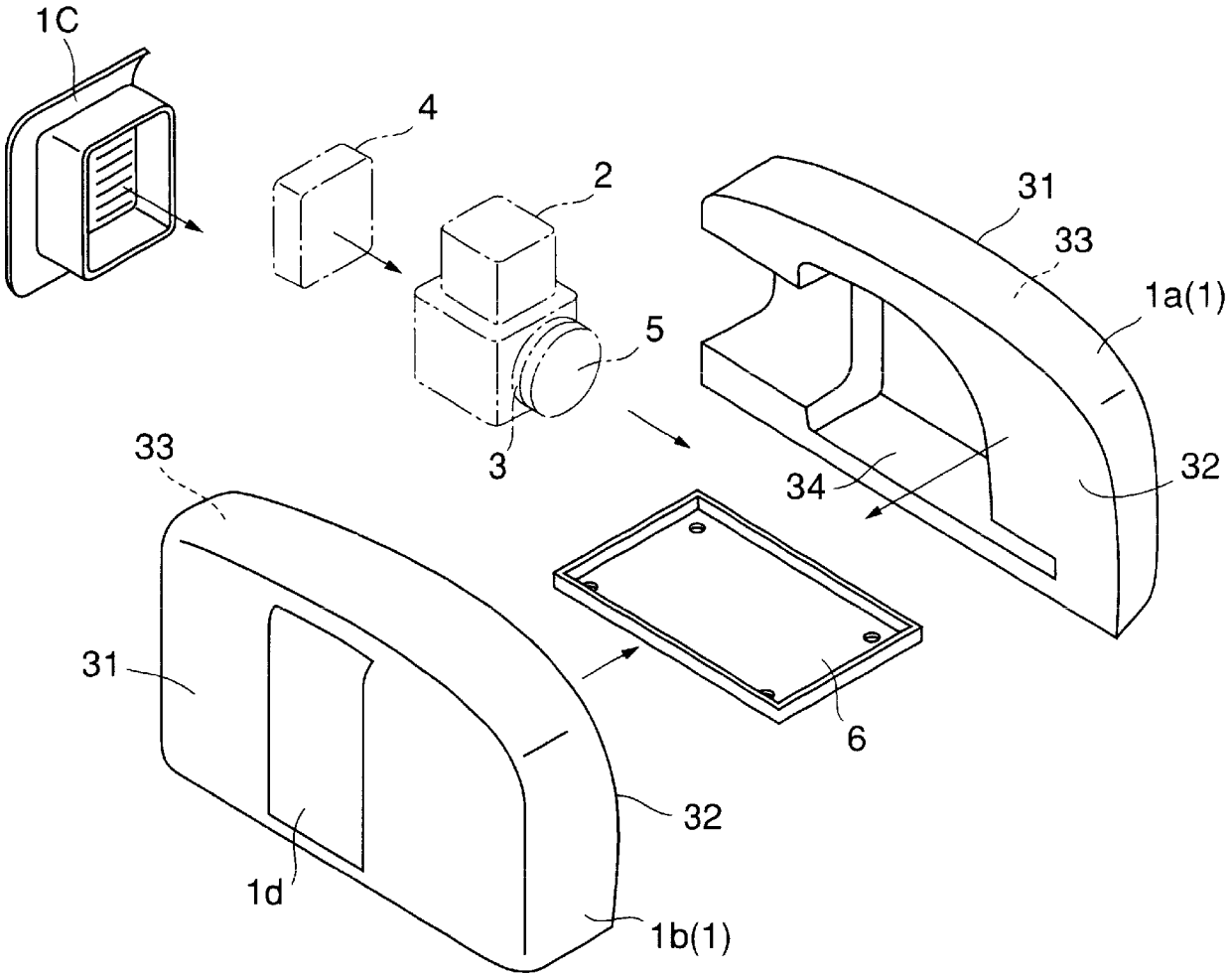
FIG. 4 is a schematic illustration of the engine generator shown in FIG. 1.

In detail, the engine cover 1 is constructed of the left and right covers 1*a* and 1*b* made of polypropylene and a rear cover 1*c* made of nylon. The cover 1*b* is provided with a maintenance door 1*d*, as illustrated in FIG. 4. The covers 1*a* and 1*b* are formed by blow moulding. The covers have an outer wall 31 of a specific appearance according to design that forms an overall appearance of the engine generator and an internal wall 32 that is a partition for a component room 34 containing the engine 2, the generator 3, and so on. Formed between the outer and the inner walls 31 and 32 is a hollow space 33. This structure makes up a hollow double-wall structure for the covers 1*a* and 1*b*.

Situated in the covers 1*a* and 1*b* is the engine 2 that will generate heat of high temperature. The covers 1*a* and 1*b* are therefore made of polypropylene of high heat resistance that is strengthened by blow moulding. The rear cover 1*c* is formed by nylon-moulding for covering the muffler 4 that will generate heat of higher temperature.

The inner wall 32 of the covers 1*a* and 1*b* forms a cooling-air passage between the covers for circulating a cooling air from the cooling fan 5. In other words, the component room 34 surrounded by the inner wall 32 is used as a space for containing the engine, etc., and also as an air duct. Although not shown in the drawings, an air-intake opening is provided at the right side of the covers 1*a* and 1*b*, for taking a cooling air. A cooling air is taken inside the engine cover 1 through the opening when the cooling fan 5 is driven. The cooling air is cooled by the cooling fan 5 and fed to the generator 3 side. While circulating in the component room 34, the cooling air is cooling the generator 3, the engine 2 and the muffler 4 in this order and exhausted outside the engine cover 1. In side the air-intake opening, a labyrinth is formed by the inner wall 32 of the covers 1*a* and 1*b* for reduction of suction noise that will be generated while taking air inside the engine cover 1.

As disclosed above, in the engine generator according to the present invention, the engine 2 etc., are protected by the covers 1*a* and 1*b* of hollow double-wall structure, and the hollow space is used as a cooling-air passage. The present invention therefore achieves reduction of the number of assembly components while maintaining high cooling efficiency. Moreover, thanks to the hollow space 33 filled with air inside the covers 1*a* and 1*b*, the present invention achieves high sound insulation capability.

Figure 2:
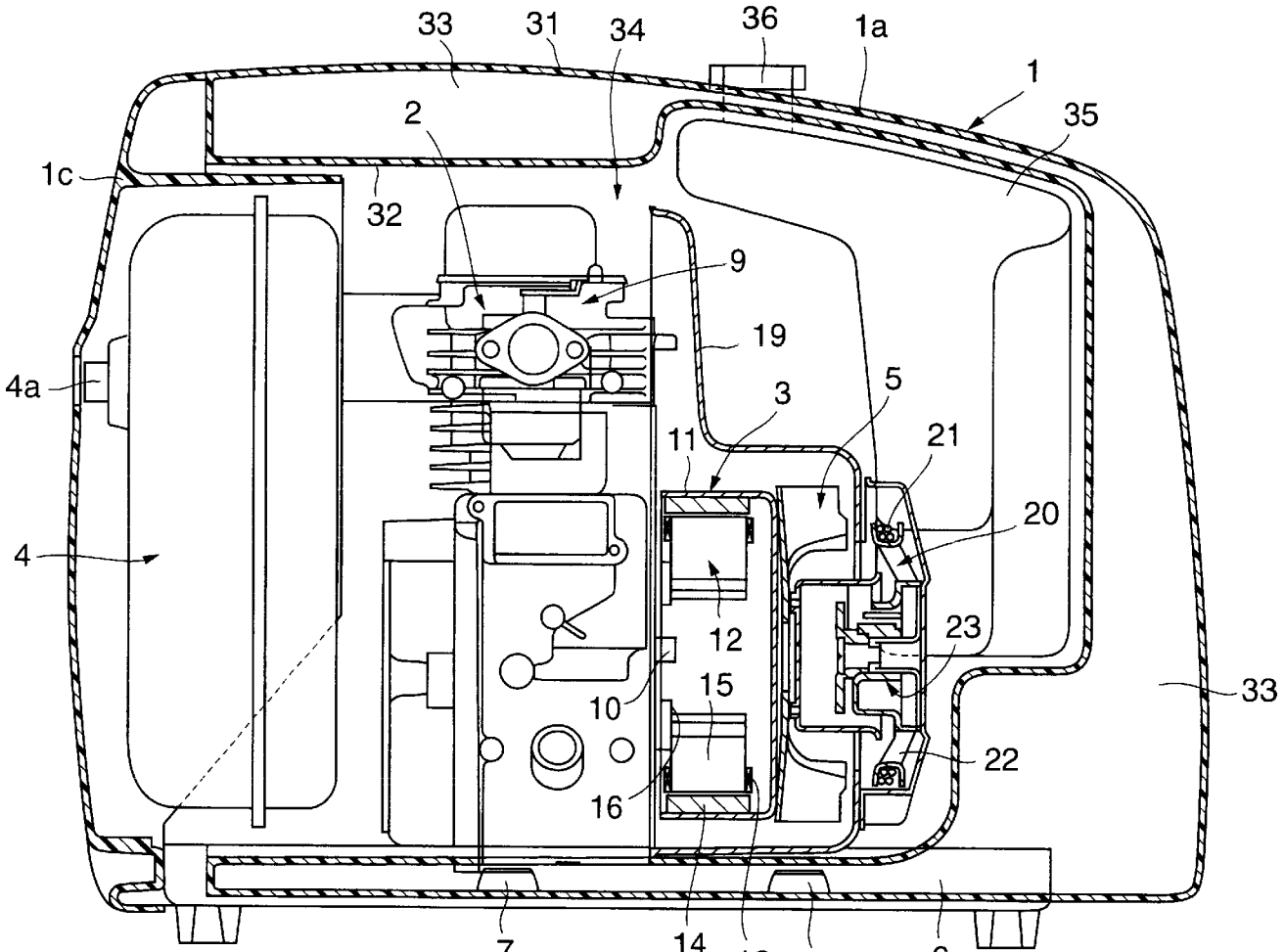
FIG. 2 is a sectional view of the engine generator taken in a direction X in FIG. 1.
Figure 3:
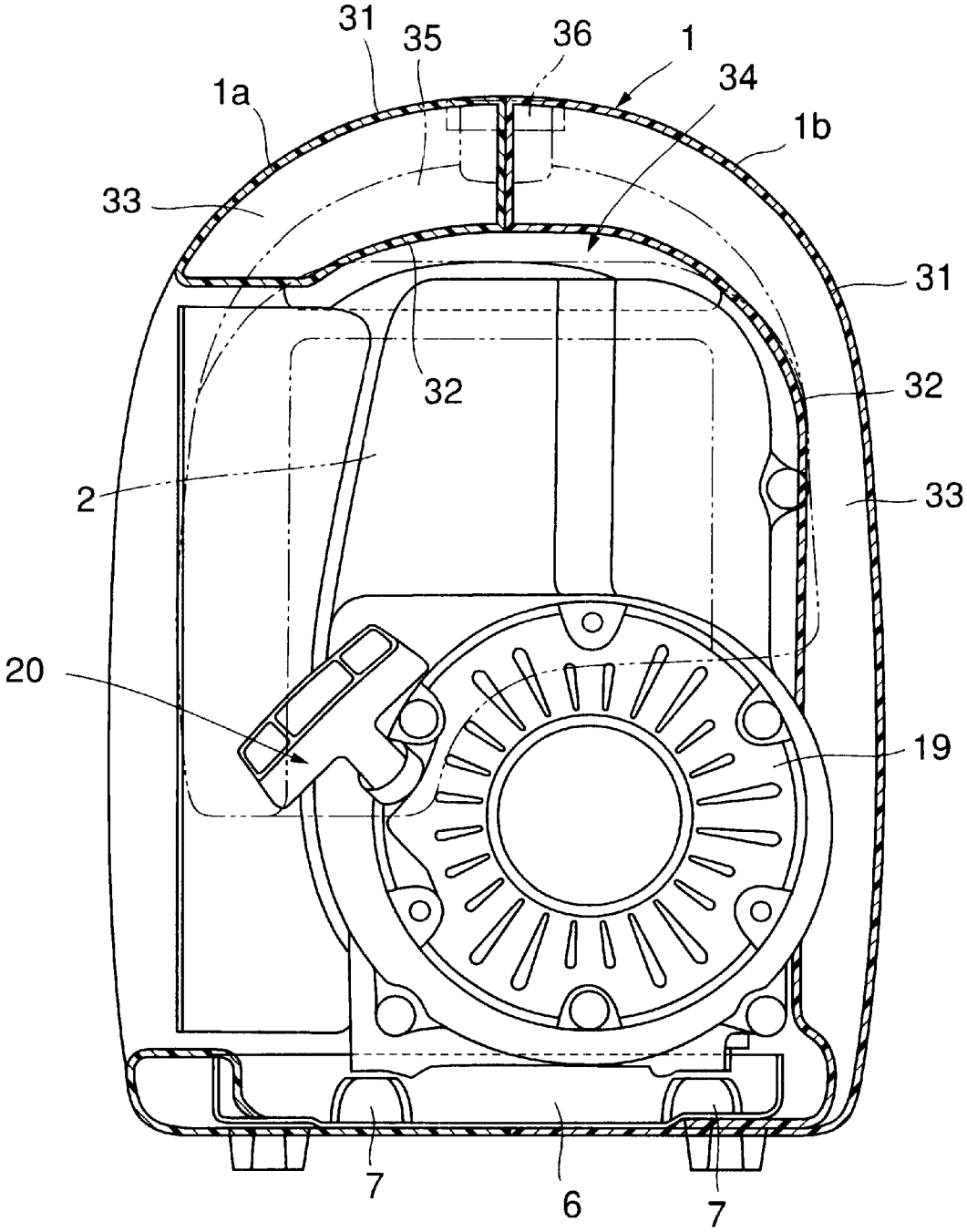
FIG. 3 is a sectional view of the engine generator taken in a direction Y in FIG. 1.

As illustrated in FIGS. 2 and 3, a base 6 made of steel plate is fixed under the covers 1*a* and 1*b*. Fixed on the base 6 are vibration insulators 7 on which the engine 2 is mounted.

The engine 2 in this embodiment is a four-cycle engine. In FIG. 1, air taken in through an air cleaner 8 is mixed with fuel in a carburetor 9 to become an air-fuel mixture that is ignited to rotate a crankshaft 10. The rotation of the crankshaft 10 drives the generator 3 that is an outer-rotor type multipolar dynamo situated on the right side of the engine 2. Gas exhausted from the engine 2 is fed to the muffler 4 situated on the left side of the engine 2.

The generator 3 works while a cylindrical outer rotor 11 having a bottom, fixed to the crankshaft 10, and functioning as a flywheel is rotating around a coil 13 at a stator 12 side. The outer rotor 11 is situated inside the engine cover 1, a part thereof at the engine 2 side being opened. Several magnets 14 are provided on the inner peripheral surface of the outer rotor 11. The stator 12 has a stator core 15 with several yokes projected outwards in all directions, on each yoke the coil 13 being turned around. The stator core 15 is fixed on a side wall 16 of a crank case of the engine 2 and housed within the outer rotor 11.

The cooling fan 5 is fixed on the back of the bottom of the outer rotor 11 so as to face the engine 2. The generator 3 and the cooling fan 5 are protected by a fan cover 19. The cooling fan 5 rotates with the outer rotor 11 while the crankshaft 10 is rotating, to take air inside the engine cover 1 from the right side of the fan cover 19 and supply a cooling air to the engine 2 side in FIG. 1.

Provided outside the fan cover 19 is a recoiled stator 20 having a clutch mechanism 23 that connects and disconnects the cooling fan 5 and a wheel 22 around which a rope 22 is wound. A user pulls the rope 21 to rotate the wheel 22, thus the cooling fan 5 connected by the clutch mechanism 23 is also rotated. This movement rotates the crankshaft 10 to start the engine 2.

Provided further inside the engine cover 1 is a fuel tank 35, as shown in FIGS. 2 and 3. A fuel supplying opening 36 is provided over the fuel tank 35, from which gasoline is poured into the tank. The gasoline in the fuel tank 35 is consumed to start the engine 2 and also simultaneously drive the generator 3.

It is further understood by those skilled in the art that the foregoing description is a preferred embodiment of the disclosed apparatus and that various change and modification may be made in the invention without departing from the spirit and scope thereof.

For example, although the embodiment employs a four-cycle engine as the engine 2, a two-cycle engine can be used instead.

Moreover, electromotive force generated on the coil 13 may be converted into an A. C. current of a specific frequency by a controller having an inverter. Thanks to power supply with frequency conversion by an inverter, there is no need to maintain an engine speed at constant for keeping output frequency without respect of load, thus driving the engine 2 at an optimum condition according to load. Therefore, the present invention achieves a low engine speed compared to a well-known engine generator, except at a large load, for improving sound insulation and fuel efficiency.

As disclosed above, the engine generator according to the present invention is provided with an engine cover protecting an engine, a generator, muffler, etc., which is a double-wall structure of an outer wall, an inner wall forming a space for housing the engine and functioning as a cooling air passage through which the engine and muffler are cooled, and a hollow inner space formed between the outer and the inner wall.

Thanks to the structure in that a part of the engine is used as a cooling air passage, the present invention offers high cooling efficiency and reduction of components, that reduces the number of assembly steps, thus achieving cost down markedly.

What is claimed is:

1. An engine generator, comprising:

an engine;

a muffler;

a generator driven by said engine; and an engine cover for housing said engine, said muffler and said generator, and formed as a hollow double-wall structure by forming a hollow space therein, said engine cover including, an outer wall forming an overall appearance of said engine generator, an inner wall forming a cooling-air passage through which said engine and muffler are cooled.

2. The engine generator according to claim 1, wherein said engine cover is made of synthetic resin.

3. The engine generator according to claim 2, wherein said engine cover is formed by blow molding.

4. The engine generator according to claim 1, wherein said engine cover is made of polypropylene.

5. The engine generator according to claim 1, wherein said engine cover has a portion made of nylon, that covers said muffler.

* * * * *